United States Patent [19]

Polaschegg

[11] Patent Number: 4,922,975

[45] Date of Patent: May 8, 1990

[54] APPARATUS FOR MAKING MIXTURES OF PHARMACEUTICAL LIQUIDS

[75] Inventor: Hans-Dietrich Polaschegg, Oberursel, Fed. Rep. of Germany

[73] Assignee: Fresenius AG, Fed. Rep. of Germany

[21] Appl. No.: 3,810

[22] Filed: Jan. 16, 1987

[30] Foreign Application Priority Data

Jan. 24, 1986 [DE] Fed. Rep. of Germany ..... 3602075

[51] Int. Cl.[5] ..... B65B 3/30; B67C 3/02

[52] U.S. Cl. ..... 141/104; 141/63; 141/65; 141/83; 141/94; 141/98; 141/105; 141/107; 141/114; 141/314

[58] Field of Search ..... 141/313, 314, 83, 94–96

[56] References Cited

U.S. PATENT DOCUMENTS

| | | | |
|---|---|---|---|
| 3,722,557 | 3/1973 | Huggins | 141/59 |
| 3,749,285 | 7/1973 | Latham, Jr. | 222/58 |
| 3,866,474 | 2/1975 | Hasselmann | 141/114 X |
| 3,965,946 | 6/1976 | D'Alo | 141/114 |
| 4,060,107 | 11/1977 | Waftulin | 141/7 |
| 4,191,183 | 3/1980 | Mendelson | 141/107 X |
| 4,306,557 | 12/1981 | North | 141/59 X |
| 4,363,340 | 12/1982 | Naftulin | 141/59 X |
| 4,513,796 | 4/1985 | Miller et al. | 141/83 |
| 4,648,430 | 3/1987 | DiGianfilippo et al. | 141/83 X |
| 4,718,467 | 1/1988 | DiGianfilippo et al. | 141/105 |
| 4,789,014 | 12/1988 | DiGianfilippo et al. | 141/83 |
| 4,807,676 | 2/1989 | Cerny et al. | 141/83 X |

FOREIGN PATENT DOCUMENTS

| | | |
|---|---|---|
| 38339 | 12/1985 | European Pat. Off. . |
| 3315031 | 9/1985 | Fed. Rep. of Germany . |
| WO84/139 | 1/1984 | PCT Int'l Appl. . |

*Primary Examiner*—Ernest G. Cusick

*Attorney, Agent, or Firm*—Andrus, Sceales, Starke & Sawall

[57] ABSTRACT

An apparatus for making mixtures of pharmaceutical liquids has a plurality of supply vessels for the mixture components. The supply vessels are connected via a tubing system to a container to be filled with the mixture. The tubing system includes a drip chamber. The container is arranged in a vacuum chamber. The vacuum chamber has a temperature sensor and a pressure sensor which are connected to a control device. For preparing the mixture, and using the law of the general gas equation, each mixture component is sequentially drawn, via the drip chamber, to the container by the vacuum in the chamber. The pressure and temperature in the vacuum chamber are monitored so that when the particular predetermined volume of one component is reached in the container, the supply vessel for that component is closed off, and the supply vessel for another component is opened.

8 Claims, 2 Drawing Sheets

| | |
|---|---|
|   | $\frac{P_0 \cdot V_0}{T_0} = C$ <br> $V = \frac{C \cdot T_a}{P_a} \Rightarrow \frac{V \cdot P_a}{T_a} = C$ |
|   | $V_1 = V_0 - \frac{C \cdot T_1}{P_1}$ |
|   | $V_2 = V_0 - \frac{C \cdot T_2}{P_2}$ |
|   | $V_3 = V_0 - \frac{C \cdot T_3}{P_3}$ |

APPARATUS FOR MAKING MIXTURES OF PHARMACEUTICAL LIQUIDS

BACKGROUND OF THE INVENTION

The invention relates to an apparatus for making mixtures of pharmaceutical liquids from at least two mixture components which are contained in supply vessels, wherein the container to be filled is received in an apparatus comprising a vacuum chamber and is connecting via a tube and a tube connector to the connection tubes of the supply vessels.

The invention further relates to an apparatus for making mixtures of pharmaceutical liquids comprising at least two supply vessels containing the individual mixture components, a connection tube for each supply vessel which open into a tube connector which connects the connection tubes via a further tube to one of the containers to be filled, a vacuum chamber which contains the container and is connected to a vacuum pump, a shut-off means, preferably in the form of a clamp, for each of the connection tubes and at least one means for detecting the presence of air.

A method of the aforementioned type is known for example from DE-PS 3,315,031. In this known method the mixture is made in an apparatus comprising a vacuum chamber for receiving the container to be filled which is connected to the individual supply vessels containing the mixture components. Each supply vessel is connected via a connecting tube by means of a tube connector to a tube connected to the container.

To determine when the desired predetermined amount of each mixture component has been reached, in the method according to the prior art either the air entry into the individual connection tubes or the respective weight of the container is determined and therefore the respective connecting tubes are clamped off.

A disadvantage here however is that, in the method according to the prior art and thus in the apparatus according to the prior art as well, the apparatus expenditure necessary is high because in the one case for each connecting tube an air-detecting means must be provided and in the other case a weighing means must be disposed in the vacuum chamber on which the container is suspended in a freely movable manner so that the respective weight determinations can be made.

Further mixing apparatuses and devices for them are known for example from U.S. Pat. Nos. 3,722,557 and 3,749,285, the PCT publication 84/138 or European patent 38,339.

U.S. Pat. No. 3,722,557 only describes a vacuum mixing chamber without going into detail regarding the nature of the mixing method.

The mixing apparatus described in European patent 38,339 proceeds from the aforementioned vacuum mixing chamber and merely additionally employs a sterile filter, no further details on the mixing method itself being given.

The mixing apparatus described in U.S. Pat. No. 3,749,285 merely explains the mixing of several liquids, the mixing operation itself being controlled by weight.

Finally, PCT publication 84/138 likewise describes a weight-controlled mixing apparatus in which a peristaltic pump is associated with each bag containing a medical liquid and is activated corresponding to a predetermined program in accordance with the amount to be mixed.

SUMMARY OF THE INVENTION

In the light of this prior art the object underlying the present invention is to provide an apparatus for making mixtures of pharmaceutical fluids or liquids of the type mentioned at the beginning which permits a considerable reduction of the apparatus expenditure whilst maintaining the accuracy and versatility for making mixtures.

This object is achieved according to the invention in that the desired predetermined amount of each mixture component is reached by determining the change of the partial vacuum and the temperature in the vacuum vessel. In the apparatus of the invention the vacuum chamber is provided with at least one temperature sensor and one pressure sensor which are connected to a control or regulating means.

In the method and apparatus according to the invention the validity of the general gas equation $$\frac{P_0 \cdot V_0}{T_0} = C$$

is utilized, and, as a result, to determine the individual mixture components in the container, it is only necessary to determine the change in the partial vacuum and the temperature in the vacuum chamber. This leads to a considerable simplification of the method and furthermore to a great reduction in the expenditure on the apparatus. This is because the vacuum chamber for determining the reaching of the desired predetermined amount of each mixture component need be provided only with at least one temperature and pressure sensor which are connected to a control and regulating means which is present in any case for controlling the system.

The subsidiary claims set forth advantageous further developments of the apparatus according to the invention.

According to a preferred embodiment detection of the presence of air in the supply lines is carried out centrally between the tube connection and the vacuum chamber. This makes a further simplification of the entire apparatus and execution of the method possible because it is only necessary to provide one air-detecting means and carry out only one measurement of any air component, this being provided in the apparatus according to the invention in particular as an additional safety measure.

Provision of a drip chamber between the vacuum chamber and the tube connector has the additional advantage that the connection lines can be vented in simple manner individually before mixing is carried out.

With the aid of the control or regulating means, which can be connected to clamps in the connection lines and elsewhere, the air-detecting means and the vacuum pump, the invention can advantageously be automated and this leads to further simplification of operation.

BRIEF DESCRIPTION OF THE DRAWING

Further details, features and advantages of the invention will be apparent from the following description of an example of embodiment with the aid of the drawings, wherein.

DESCRIPTION OF THE PREFERRED EMBODIMENT

Figure 1:
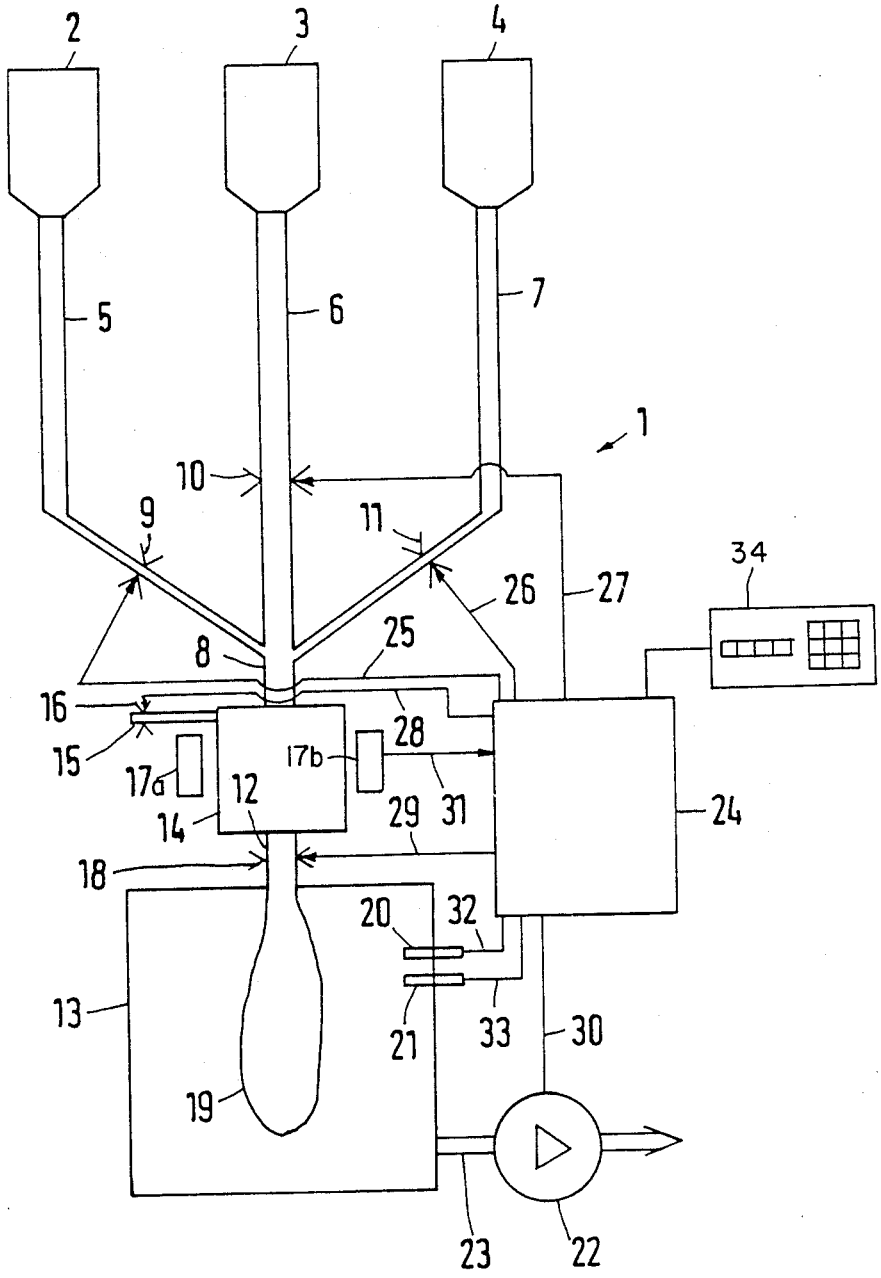
FIG. 1 is a schematically simplified illustration of an embodiment of the apparatus according to the invention.

FIG. 1 shows an embodiment of an apparatus 1 according to the invention which comprises three supply vessels 2, 3 and 4 for the individual mixture constituents. In every case at least two supply vessels are provided but of course it is possible to provide more than two or three supply vessels as illustrated depending on how many mixture components are present.

The supply vessels 2, 3 and 4 are each connected to a connecting tube 5, 6 and 7, said tubes opening into a tube connector 8.

Disposed in each connecting tube 5, 6 and 7 is a shutoff member 9, 10 or 11, for example in the form of a clamp.

The tube connector 8 connects the connecting tubes 5, 6 and 7 to a further tube 12. In the tube 12 between the tube connector 8 and a vacuum chamber 13 a drip chamber 14 is disposed which in the example has a vent line 15 which is provided with a shutoff member 16 which can be formed as a clamp, cap or also as a valve. Furthermore, the drip chamber 14 is provided with a means 17*a–b* for detecting the presence of air.

Between the drip chamber 14 and the vacuum chamber 13 in the tube 12 a further shutoff member 18 is disposed which can also be constructed as a clamp.

The tube 12 opens into a container 19 which is disposed in the vacuum chamber 13. The supply vessels 2, 3 and 4 are thus connected via the connecting tubes 5, 6 and 7, the tube connector 8, the tube 12 and the drip chamber 14 to the container 19 so that via the latter conduit means the mixture components contained in the supply vessels 2, 3 and 4 can be conducted into the container 19.

The vacuum chamber 13 further comprises if required a temperature sensor 20 and a pressure sensor 21. To enable the vacuum chamber 13 to be evacuated a vacuum pump 22 is connected thereto via a connecting conduit 23 as shown in detail in FIG. 1.

Finally, in the embodiment of the apparatus 1 according to the invention illustrated in FIG. 1 a control or regulating means 24 is provided which is connected via control lines 25 to 30 to the shutoff members 9, 10, 11, 16 and 18 respectively and via the control line 30 to the vacuum pump 22. The air-detecting means 17*a–b* and the temperature sensor 20 and pressure sensor 21 are likewise connected via measurement value lines 31, 32 and 33 respectively to the closed-loop control or regulating means 24 so that the measured values determined are collected in said means, stored and possibly further processed to control the remaining devices.

It is additionally pointed out that it is of course also possible to operate said shutoff members and the vacuum pump 22 manually. It is further provided out that downstream of the drip chamber 14 a connection, not illustrated, is provided which has a seal and leads to the container 19 which is suspended in the vacuum chamber 13. Container 19 and can be constructed as a bag. For air-detecting means 17*a–b*, optical or ultrasonic devices can be employed.

In the operation of the apparatus according to the invention the container 19 is suspended in the vacuum chamber 13 and sealed in a vacuum-tight manner by the seal disposed on said chamber. The tubing system 5, 6, 7 and 12 is introduced into the air-detecting means 17*a–b* and the corresponding clamps 9, 10, 11 and 18 and is thereafter connected to the supply vessels 2, 3 and 4.

Thereafter the tubes 5, 6 and 7 must first be vented. For this purpose the clamps 9, 10 and 11 are opened in succession either manually or by the control device 24, whereafter the vent line 15 should be opened by means of the shutoff member 16 so that the air can escape. Then, after opening any closure means also present, for example in the form of a breakage cone, on the supply vessels 2, 3 and 4 the respective liquid flows through the corresponding connecting tube 5, 6 and 7 into the drip chamber 14 and at the same time air can escape through the vent conduit 15. As soon as liquid has arrived in the drip chamber 14 the respective clamp 9, 10 and 11 as well as the shutoff member 16 of the vent conduit 15 are also closed. Thereafter the operation is repeated with the particular following clamp 10 and 11 and the corresponding supply vessel 3 and 4 respectively.

Parallel thereto the clamp 18 remains closed so that the empty vessel 19 is separated from the tube system. The control or regulating means 24 now activates the pump 22 so that a predetermined partial vacuum of for example $$P_o = -500 \text{ mm Hg}$$

is set in the vacuum chamber 13. By means of the temperature and pressure sensor 20 and 21 respectively at the same time the pressure and temperature are measured. When the predetermined pressure is reached the vacuum pump 22 is stopped and the pressure checked over a period of a few seconds to determine whether the system has any leaks. In the meantime the tube system is manually or automatically vented and mixing can begin. Previously, the control or regulating device has been informed via suitable input device, such as a selector switch or a keyboard 34, what volumes of the individual fluids or liquids are to be supplied. Below and in particular in FIG. 2 these volumes are designated by way of example by $V_1$ from the supply vessel 2, $V_2$ from the supply vessel 3 and $V_3$ from the supply vessel 4.

It is of course equally possible to enter the mixing ratio and the total amount and calculate the individual volumes through the control or regulating means.

At the end of the previously described evacuating operation the control or regulating means determines the pressure $P_o$ and the temperature $T_o$ of the vacuum chamber with a previously known volume $V_o$. From this the constant of the general gas equation $$C = \frac{V \cdot P_a}{T_a}$$

is calculated.

The index a refers in each case to the actual value.

Conveying a previously defined volume from for example the supply vessel 2 to the empty container 19 takes place in the following operation:

The closed-loop control or regulating means 24 opens the clamps 9 and 18. Because of the partial vacuum liquid is sucked into the container 19 and the control means 24 continuously checks the pressure and temperature via the sensors 20 and 21 in the vacuum chamber 13 and calculates therefrom the actual filling volume of the container by the formula $$V_a = V_o - \frac{C \cdot T_a}{P_a}$$

As soon as the difference between the starting volume $V_o$ and the actual volume $V_a$ is equal to the preselected volume $V_1$, which is the case when $$\frac{T_a}{P_a} = \frac{T_1}{P_1} \text{ with } \frac{CT_1}{P_1} = (V_o - V_1)$$

the control means 24 closes the clamps 9 and 18 and the same operation is repeated for the liquids of the supply containers 3 and 4, whereafter the mixture is completed.

Figure 2:
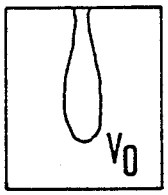
FIG. 2 is a tabular representation of different filling states of the container of the apparatus according to the invention as shown in FIG. 1 in conjunction with formulae representing the filling volume.
Figure 2:
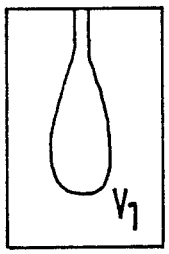
Figure 2:
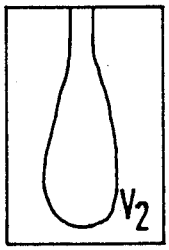
Figure 2:
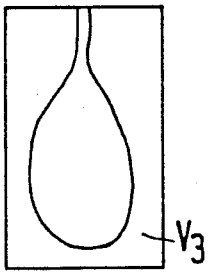

The individual fillings of the container 19 are apparent from the illustration of FIG. 2 in which in addition the respective formulae for determining the volumes $V_1$, $V_2$ and $V_3$ are given.

If during one of these filling operations one of the supply vessels 2, 3 or 4 runs out of liquid, air will be conveyed in the system and this will be detected by the air-detecting means 17*a–b*. The shutoff member 18 is then closed and in a particularly advantageous embodiment an alarm is triggered. The user then has the possibility of replacing the corresponding supply vessel 2, 3 or 4 and manually venting the corresponding connecting tube 5, 6 or 7 up to the drip chamber 14. Cancellation of the alarm condition of the air-detecting means 17*a–b* is then signalled at the control means 24 and by acknowledging this signal the user can continue the filling operation.

I claim:

1. Apparatus for making a mixture of pharmaceutical liquids in a container, the individual liquid components of the mixture being contained in at least first and second supply vessels, said apparatus comprising:

a connection tube for each supply vessel;

a tube connector means connected with said connection tubes;

a further tube for connecting said tube connector means to the container to be filled with the mixture;

a vacuum chamber for containing the container to be filled;

a vacuum pump connected to said vacuum chamber;

first and second shut off means for said connection tubes of the at least first and second supply vessels, respectively;

means for detecting the presence of air in the apparatus;

pressure sensor means for detecting negative pressure values within said vacuum chamber;

an input device for storing values of volumes of liquid components of the mixture to be transferred from the at least first and second supply vessels to the container; and control means operatively connected with said pressure sensor means, said vacuum pump, and said first and second shut off means, said control means activating said vacuum pump until a first predetermined negative pressure value is obtained in said vacuum chamber, thereafter opening said first shut off means for allowing liquid to flow from the first supply vessel to the container until a second predetermined pressure exists in said chamber, and thereafter closing said first shut off means and opening said second shut off means for allowing liquid to flow from the second supply vessel to the container until a third predetermined pressure value exists in said chamber.

2. Apparatus according to claim 1, characterized in that between the tube connector means and the vacuum chamber, a drip chamber is disposed in the further tube.

3. Apparatus according to claim 2, characterized in that the means for detecting the presence of air is disposed at the drip chamber.

4. Apparatus according to claim 2, characterized in that the drip chamber is provided with at least one venting means.

5. Apparatus according to claim 2, characterized in that between the drip chamber and the vacuum chamber a third shut off means is disposed in the further tube.

6. Apparatus according to claim 5, characterized in that the control means is connected to the third shut off means.

7. Apparatus according to claim 1, characterized in that the control means is connected to the means for detecting the presence of air.

8. Apparatus according to claim 1, characterized in that temperature sensor means are provided for detecting temperature values within said vacuum chamber, said temperature sensing means being operatively connected to said control means.

* * * * *